US006722249B2

(12) United States Patent
David

(10) Patent No.: US 6,722,249 B2
(45) Date of Patent: Apr. 20, 2004

(54) METHOD OF FABRICATING A POLISHING PAD HAVING AN OPTICAL WINDOW

(75) Inventor: Kyle W. David, Bear, DE (US)

(73) Assignee: Rodel Holdings, INC, Wilmington, DE (US)

( * ) Notice: Subject to any disclaimer, the term of this patent is extended or adjusted under 35 U.S.C. 154(b) by 61 days.

(21) Appl. No.: 10/011,358

(22) Filed: Nov. 6, 2001

(65) Prior Publication Data

US 2003/0084774 A1 May 8, 2003

(51) Int. Cl.[7] ..... B24D 11/00

(52) U.S. Cl. ..... 83/875; 83/425; 83/425.3; 451/527

(58) Field of Search ..... 83/88, 86, 452, 83/876, 884, 401, 409, 425.2, 425.3, 875; 451/6, 288, 527, 287, 534, 530, 921, 533, 539, 41; 29/24, 720, 721; 428/692, 693

(56) References Cited

U.S. PATENT DOCUMENTS

| | | | | | |
|---|---|---|---|---|---|
| 2,643,690 | A | * | 6/1953 | White | 144/136.1 |
| 4,064,626 | A | * | 12/1977 | Meshulam et al. | 30/287 |
| 4,243,084 | A | * | 1/1981 | Moody | 144/39 |
| 4,391,170 | A | * | 7/1983 | Boverman et al. | 83/76.7 |
| 4,685,363 | A | * | 8/1987 | Gerber | 83/22 |
| 4,833,764 | A | * | 5/1989 | Muller | 29/40 |
| 4,928,590 | A | * | 5/1990 | Joyama et al. | 99/576 |
| 5,081,051 | A | * | 1/1992 | Mattingly et al. | 451/56 |
| 5,163,348 | A | * | 11/1992 | Kitada et al. | 83/13 |
| 5,203,086 | A | * | 4/1993 | Dann | 30/293 |
| 5,489,233 | A | * | 2/1996 | Cook et al. | 451/41 |
| 5,575,099 | A | * | 11/1996 | Strobel et al. | 40/584 |
| 5,733,081 | A | * | 3/1998 | Dowdle et al. | 409/137 |
| 5,893,796 | A | * | 4/1999 | Birang et al. | 451/526 |
| 6,077,783 | A | | 6/2000 | Allman et al. | |
| 6,102,775 | A | | 8/2000 | Ushio et al. | |
| 6,146,248 | A | | 11/2000 | Jairath et al. | |
| 6,190,234 | B1 | | 2/2001 | Swedek et al. | |
| 6,213,845 | B1 | | 4/2001 | Elledge et al. | |
| 6,248,000 | B1 | * | 6/2001 | Aiyer | 451/41 |
| 6,358,130 | B1 | * | 3/2002 | Freeman et al. | 451/285 |
| 6,454,630 | B1 | * | 9/2002 | Tolles | 451/6 |
| 6,511,363 | B2 | * | 1/2003 | Yamane et al. | 451/6 |
| 2001/0031610 | A1 | * | 10/2001 | Budinger et al. | 451/41 |

FOREIGN PATENT DOCUMENTS

| | | |
|---|---|---|
| EP | 0 663 265 A | 7/1995 |

* cited by examiner

*Primary Examiner*—Allan N. Shoap
*Assistant Examiner*—Ghassem Alie
(74) *Attorney, Agent, or Firm*—Gerald K. Kita; Edwin Oh; Blake T. Biederman

(57) ABSTRACT

A method of fabricating a polishing pad in which a pad material includes a polishing layer overlying a substantially optically transparent backing layer is subjected to a process in which an optical window is formed in the pad material by removing a portion of the polishing layer and exposing an underlying portion of the substantially optically transparent backing layer. Prior to forming the optical window, the polishing layer is bonded to the backing layer to form a sealed interface, then a portion of the polishing layer is mechanically cut away from the backing layers. Since the backing layer is not pierced during the removal process, a liquid, such as an aqueous polishing slurry, cannot leak through the optical window and on to underlying portions of a polishing apparatus to which the pad material is mounted.

3 Claims, 4 Drawing Sheets

METHOD OF FABRICATING A POLISHING PAD HAVING AN OPTICAL WINDOW

CROSS REFERENCE TO RELATED APPLICATIONS

Related subject matter is disclosed in copending, commonly-assigned U.S. patent application Ser. No. 09/671,774, filed Sep. 28, 2000 and U.S. provisional patent application Ser. No. 60/298,599, filed Jun. 15, 2001, both of which are incorporated by reference herein.

FIELD OF THE INVENTION

This invention relates, generally, to polishing pads used for creating smooth, ultra-flat surfaces on items such as glass, semiconductors, dielectric and metal composites and integrated circuits and, more particularly, to methods for fabricating polishing pads that enable optical end-point detection.

BACKGROUND OF THE INVENTION

The increasing need to form planar surfaces on a variety of materials has led to the development of process technology known as chemical-mechanical-polishing (CMP). In the CMP process, a substrate to be polished is brought into contact with a polishing pad in the presence of a polishing slurry. As the substrate is brought into frictional contact against the polishing pad, pressure created between the pad and substrate, in conjunction with the action of the polishing slurry, polishes away surface layers of the substrate. The polishing process is assisted by chemical compounds within the polishing slurry that facilitate removal of the material being polished. By carefully selecting the chemical components of the polishing slurry, the polishing process can be made more selective to one type of material than to another. The ability to control the selectivity of a CMP process has led to its increased use for delicate surface applications, such as the fabrication of complex integrated circuits.

A common requirement of all CMP processes is that the substrate be uniformly polished and that the amount of material removed by the polishing process be controlled in a repeatable fashion. Recently, optical techniques have been developed to monitor the polishing process and to determine a process end-point. Typically, the optical end-point detection method involves generating a light beam and reflecting the light beam off of the surface being polished. Because both the surface being polished and the polishing pad are in continuous motion during the polishing process, it is difficult to construct an optical pathway for continuous light transmission. In one technique, an aperture is created in the polishing pad and aligned to an opening in the platen of a CMP apparatus. A stationary light source is positioned in proximity to the platen and opposite to the side of the platen supporting the polishing pad. As the opening in the platen and corresponding aperture in the polishing pad pass over the light source, the light beam emitted by the light source is momentarily reflected by the surface being polished. The reflected optical signals are collected by a detector over time and electrically analyzed to determine a polishing end-point.

The creation of an aperture or window for optical transmission is not straightforward and requires that several processing issues be addressed. For example, a simple hole in the polishing pad would permit polishing slurry to seep through the opening and along the interface between the polishing pad and the platen. Since it is important that the pad be secured to the platen, the incursion of foreign substances between the platen and the polishing pad must be prevented. Further, most polishing apparatus are configured to have electronic systems and supporting mechanical devices below the platen. Accordingly, leakage of polishing slurry and other liquids from the polishing-side of the platen must also be prevented.

Polishing pads are typically composed of two or more overlying layers of different materials. Typically, a polishing pad includes at least a polishing layer overlying a backing layer. Additionally, an adhesive layer is commonly used to adhere the backing layer to the polishing platen. Since the polishing layer and the backing layer are typically composed of different materials, the optical transparency of the materials also differs. Most materials used as a polishing layer are opaque to light over a wavelength range useful for end-point detection. Many of the materials used to construct a backing layer, however, are transparent to light. Accordingly, polishing pads have been fabricated in which sections of the polishing layer are removed and replaced with an optically transparent material. Although this technique is effective at creating an optical pathway, it involves relatively complex processing techniques. In one common process, a section of the polishing layer is removed and an optically transparent material is stitched into the opening. This type of process is time consuming and increases the cost of a polishing pad produced by this method. Accordingly, more efficient process techniques are necessary to fabricate polishing pads having optically transparent regions to enable end-point detection.

BRIEF SUMMARY OF THE INVENTION

The present invention is for a method of fabricating a polishing pad having an optical window. The method includes providing a pad material having a polishing layer overlying a substantially optically transparent layer. A portion of the polishing layer is removed, such that an underlying portion of the optically transparent layer is exposed. Since the underlying substantially optically transparent layer is not pierced when the portion of the polishing layer is removed, the process of the invention provides an optical pathway without producing a leakage path for polishing slurry.

In one embodiment of the invention, the portion of the polishing layer is removed by cutting away the polishing layer using a cutting tool. The cutting tool cuts away a portion of the polishing layer from the substantially optically transparent layer, while the pad material is moved relative to the assembly holding the cutting tool. The cutting tool and pad material are brought into motion relative to one another, such that a precisely defined portion of the polishing layer is removed by the cutting tool. Automation of the cutting process enables the rapid formation of an optical pathway in a polishing pad, and further enables a reduction in the processing time necessary to fabricate such a polishing pad.

In a specific embodiment of the invention, the pad material is placed on a flat cutting surface and a cutting tool is transversely mounted to a carriage assembly. In the fabrication process, the carriage assembly and cutting surface are moved toward one another at substantially a right angle. A rotating disk having a plurality of cutting teeth arranged on the perimeter surface of the disk makes contact with the polishing layer, such that a controlled amount of polishing layer material is removed from the substantially optically transparent layer.

BRIEF DESCRIPTION THE DRAWINGS

Figure 1:
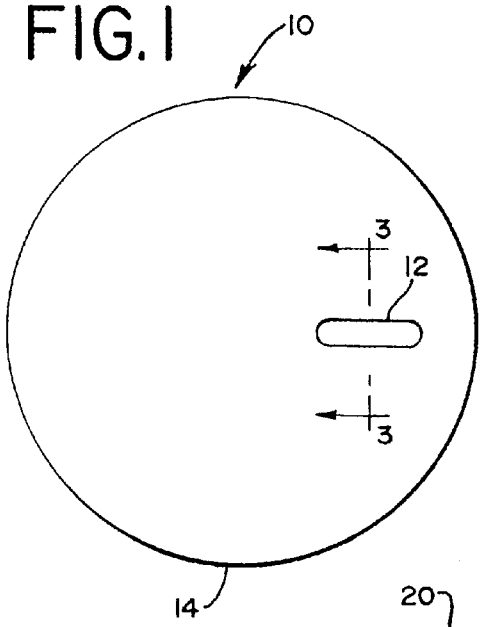
FIG. 1 illustrates a top view of a circular polishing pad having an optical window therein.

It will be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF PREFERRED EMBODIMENT

Figure 2:
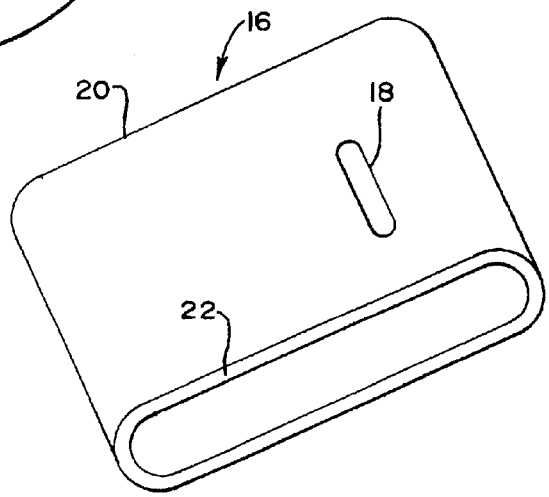
FIG. 2 illustrates a perspective view of a belt-type polishing pad having an optical window therein.

Illustrated in FIG. 1 is a top view of a circular polishing pad 10. Circular polishing pad 10 is configured to be positioned on the rotating platen of a polishing apparatus (not shown). An optical window 12 is located in polishing pad 10 at a position offset from a perimeter 14 of polishing pad 10. A perspective view of a belt-type polishing pad 16 is illustrated in FIG. 2. Polishing pad 16 is fabricated to have an optical window 18 positioned at a location intermediate to first edge 20 and second edge 22 of polishing pad 16.

In accordance with the invention, a process is provided for fabricating a polishing pad having an optical window therein. The process of the invention can be used to fabricate a wide variety of polishing pad configurations, such as those illustrated in FIGS. 1 and 2. Although the process of the invention will be described with reference to a circular polishing pad, such as polishing pad 10, those skilled in the art will appreciate that the inventive process can be carried out to fabricate belt-type polishing pads, such as polishing pad 16, and other kinds of polishing pads having virtually any geometry.

Figure 3:
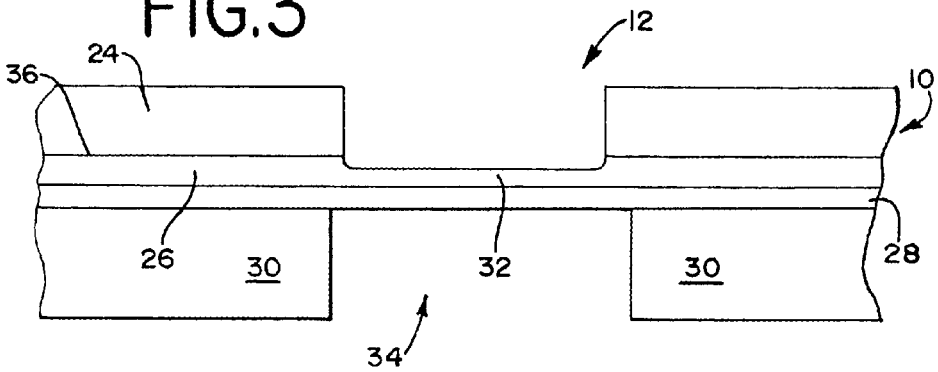
FIG. 3 illustrates, in cross-section, a portion of a polishing pad fabricated in accordance with the invention.

FIG. 3 illustrates, in cross-section, a portion of polishing pad 10 taken along section line II—II in FIG. 1. Polishing pad 10 includes a polishing layer 24 overlying a backing layer 26. An adhesive layer 28 underlies backing layer 26 and is used to adhere polishing pad 10 to a platen 30. Platen 30 is one component of a polishing apparatus (not shown).

In accordance with the invention, optical window 12 is formed in polishing pad 10 by removing a portion of polishing layer 24 from a portion 32 of backing layer 26. To form an optical pathway for use in end-point detection during a CMP process, at the time of adhering polishing pad 10 to platen 30, optical window 12 is aligned to an opening 34 in platen 30.

In forming the pad material of polishing pad 10, polishing layer 24 is bonded to backing layer 26 by adhesively bonding polishing layer 24 to backing layer 26. The bonding layer (not shown) forms a sealed interface 36 between polishing layer 24 and backing layer 26. The bonding material used to form sealed interface 36 prevents the incursion of polishing slurry along the interface and effectively excludes entry of any liquid, such as polishing slurry, water and the like, from diffusing along sealed interface 36.

In accordance with the present invention, optical window 12 is formed by cutting away a portion of polishing layer 24 and exposing an underlying portion 32 of backing layer 26. In one embodiment of the invention, the cutting process removes a surface portion of backing layer 26 in addition to a section polishing layer 24. Even though sealed interface 36 is exposed when the surface portion of backing layer 26 is removed, the adhesive bond at sealed interface 36 prevents liquids and foreign contaminants from entering sealed interface 36 at optical window 12.

Although the process of the invention is fully operable in the fabrication of polishing pads composed of a wide variety of materials, backing layer 26 is preferably formed of a material that is substantially transparent to light preferably having a wavelength range of about 100 to about 10,000 nanometers and, more preferably, about 190 to about 3500 nanometers. In one embodiment of the invention, backing layer 26 is composed of an optically transparent material such as polyethylene, polypropylene, polyurethane, polyvinylchloride, and polyethyleneterapthalate. Preferably, backing layer 26 is formed of blended polyethyleneterapthelate, which is also known under the trade name "Mylar."

Polishing layer 24 can be formed of any number of materials commonly used to fabricate pad materials. Since the process of the invention removes a section of polishing layer 24, the material can be optically opaque. Common materials used to form a polishing layer include blown polyurethane, polyester, blended polymers, microporous polyethylene, and the like. Numerous additional examples of polymer materials used in polishing pad fabrication can be found in commonly-assigned U.S. Pat. No. 5,489,233, which is incorporated by reference herein.

Adhesive layer 28 is either formed of an optically transparent material or a section in the region of optical window 12 is removed prior to mounting polishing pad 10 on platen 30. In the case where adhesive layer 28 is a pressure sensitive adhesive (PSA) a paper backing layer (not shown) is removed prior to mounting polishing pad 10 on platen 30. Accordingly, a section in the region of optical window 12 can be easily cut away prior to mounting polishing pad 10 on platen 30.

Figure 4:
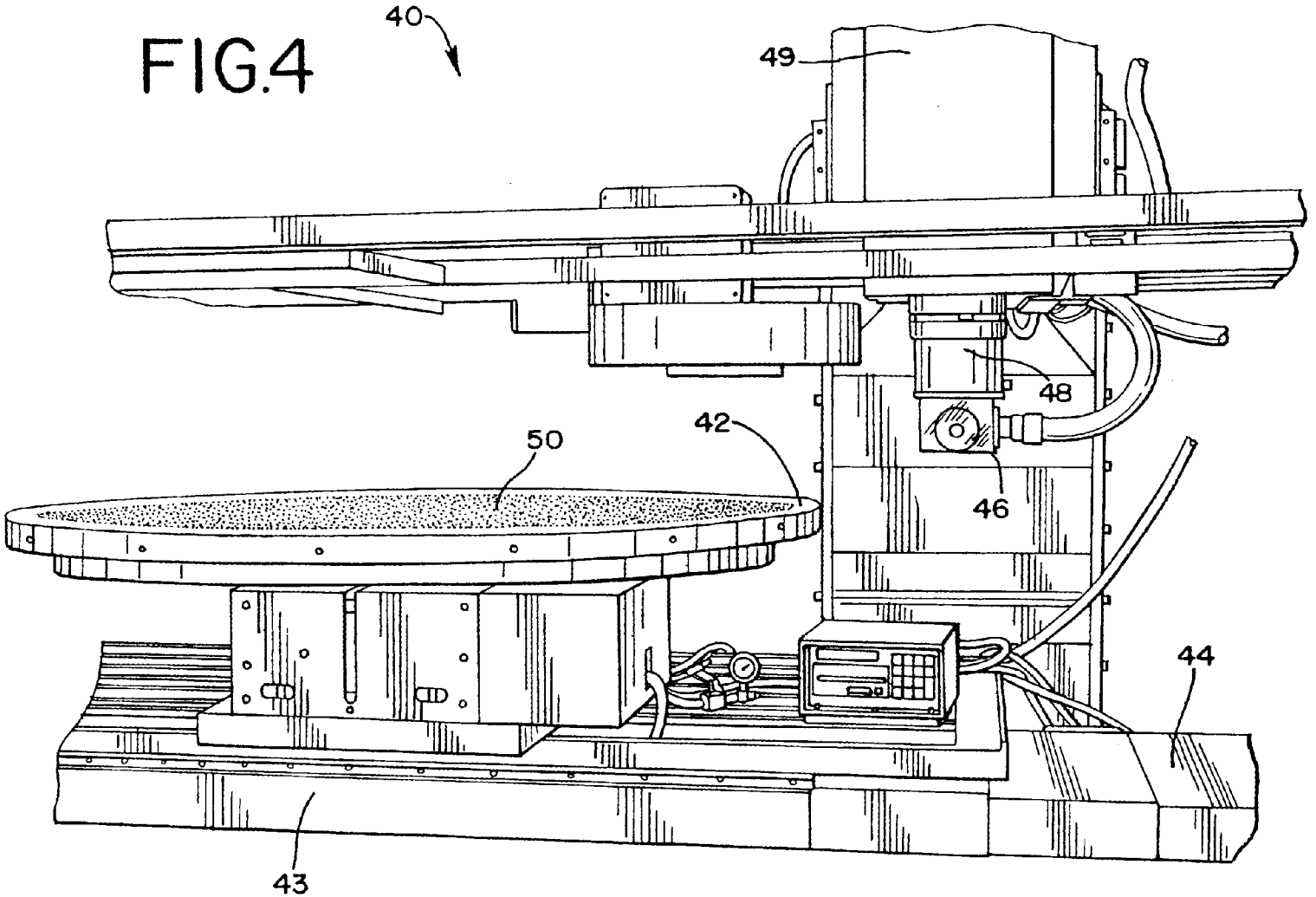
FIGS. 4 and 5 are elevational views of an apparatus useful for carrying the process in accordance with the invention.

In accordance with the present invention, an automated process is provided for forming an optical window, such as optical windows 12 and 18 in a polishing pad material. One embodiment of a grooving tool 40 that can be used in an automated polishing pad fabrication process is illustrated in FIG. 4. Grooving tool 40 includes a vacuum table 42 and a carriage assembly 43 mounted for lateral movement on a shaft horizontal 44, and cutting tool 46 transversely mounted to a shaft 48 mounted within a housing 49. The components of grooving tool 40 are shown in a load position in which a pad material 50 is placed on vacuum table 42 prior to starting the cutting process.

Figure 5:
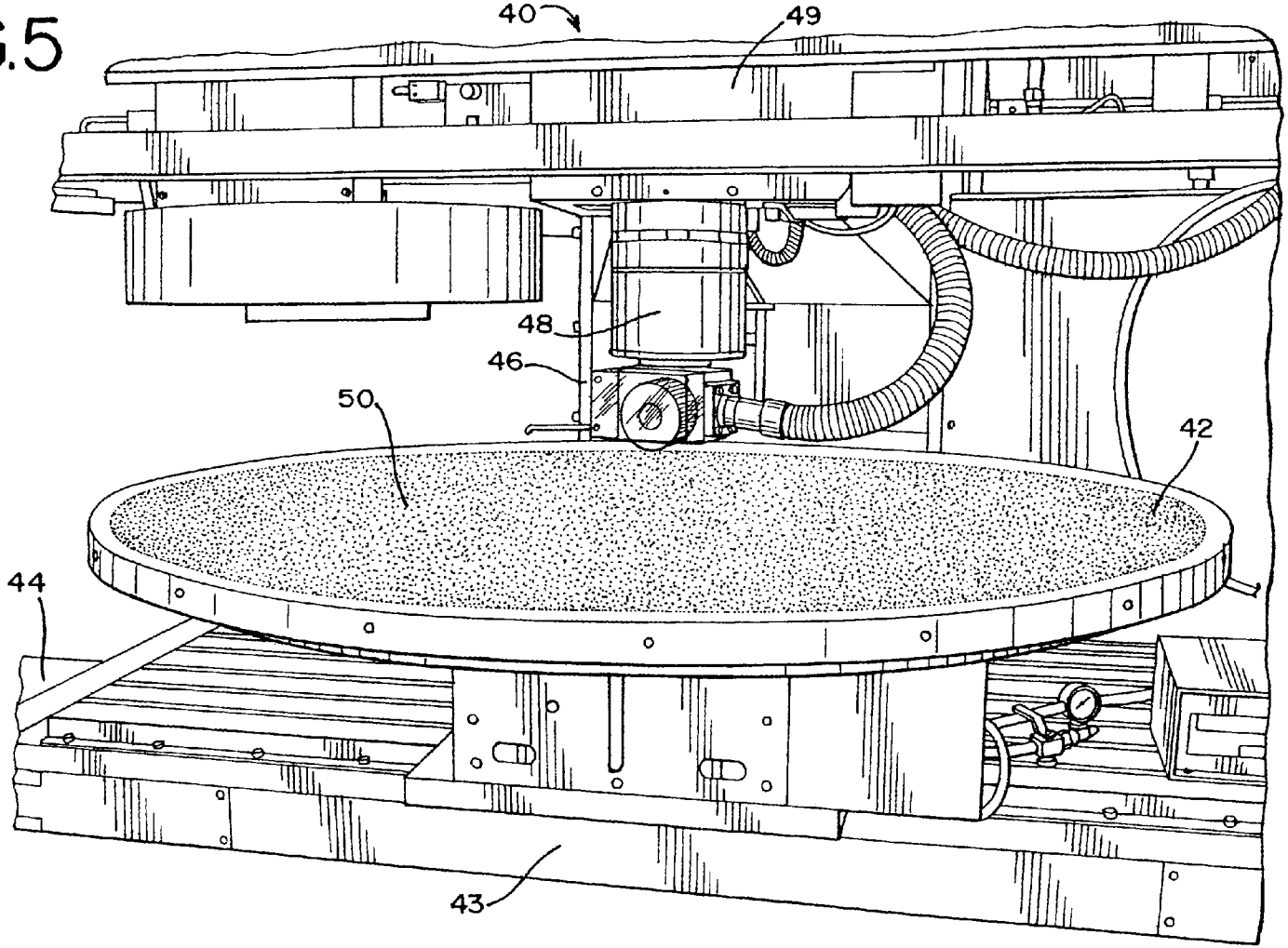

In operation, pad material 50 is placed on vacuum table 42 and secured by vacuum pressure to the surface of vacuum table 42. FIG. 5 illustrates grooving tool 40 in a cutting position, where vacuum table 42 is brought into position under cutting tool 46. Once vacuum table 42 is in cutting position, cutting tool 46 is lowered by shaft 48 until cutting tool 46 makes contact with pad material 50. Vacuum table 42 is then set in motion in a lateral direction along lateral shaft 44 and cutting tool 46 forms an optical window in pad material 50 having a desired lateral dimension. In one embodiment of the invention, pad material 50 is laterally transported on vacuum table 42 by actuating carriage assembly 43 at a linear travel rate of preferably about 10 to about 20 inches per minute and, more preferably, at a rate of about 15 inches per minute. The lateral transport rate of pad material 50 is specified relative to shaft 48, which in the illustrated embodiment is stationary.

Those skilled in the art will appreciate that numerous variations in the arrangement of the carriage assemblies supporting cutting tool 46 and vacuum table 42 are possible. Although in the embodiment illustrated in FIGS. 4 and 5, vacuum table 42 and carriage assembly 43 are arranged in a horizontal position relative to a shop floor, vacuum table 42 and carriage assembly 43 could also be positioned vertically relative to the shop floor or at an inclination angle relative to the shop floor or the like. Further, although in FIGS. 3 and 4 shaft 48 is positioned at substantially a right angle with respect to the upper surface of vacuum table 42, shaft 48 could be positioned at some other angle such as an acute or obtuse angle relative to vacuum table 42. Accordingly, all such variations and modifications are within the scope of the present invention.

Figure 6:
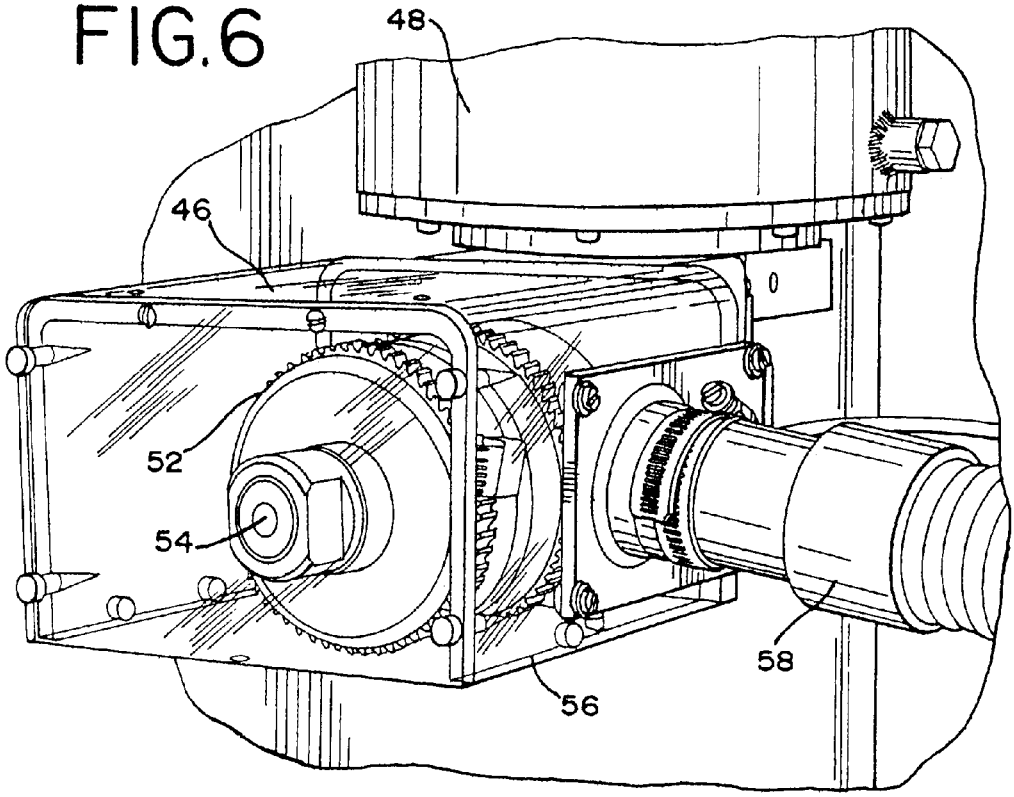
FIG. 6 is a perspective view of a cutting tool configured in accordance with one aspect of the invention that is useful for carrying out the process in accordance with the invention.

FIG. 6 illustrates a perspective view of cutting tool 46. One or more disks 52 are mounted to a rotating shaft 54. Rotating shaft 54 is transversely mounted to shaft 48. A casing 56 surrounds rotating shaft and disks 52 and has a vacuum line 58 connected to an opening in the side of casing 56. During operation, pad material cut away by disks 52 is contained within the vicinity of the rotating disks and drawn away by vacuum pressure through vacuum line 58. Although several rotating disks are illustrated in FIG. 6, those skilled in the art will recognize that the number of disks mounted to rotating shaft 54 can vary from one to several disks depending upon the number of optical openings that are desired to be simultaneously formed in pad material 50.

Figure 7:
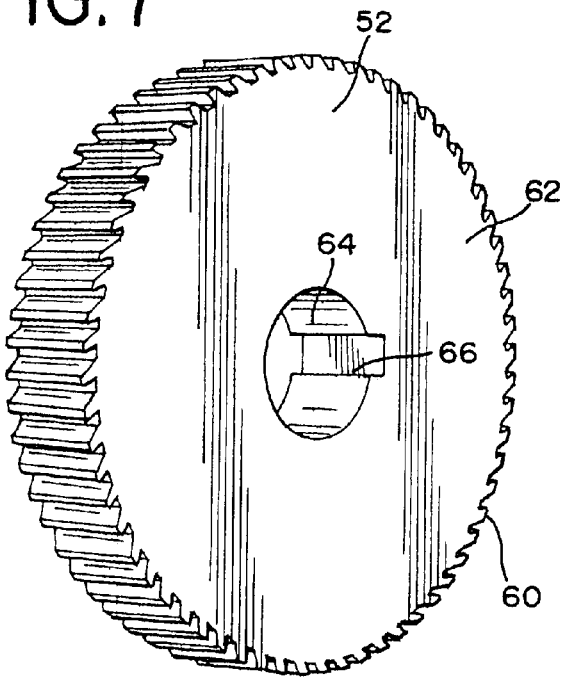
FIG. 7 is perspective view of a cutting disk configured in accordance with one aspect of the invention that is useful for carrying out a process in accordance with the invention.

Shown in FIG. 7 is a perspective view of a rotating disk 52. Rotating disk 52 has a plurality of cutting teeth 60 arranged on a perimeter surface 62. An axial opening 64 is equipped with an alignment key 66 into which a pall on shaft 54 can be inserted to rotationally engage disk 52 with shaft 54. Although cutting teeth 60 are illustrated as uniform rows of projections on perimeter surface 62 of rotating disk 52, those skilled in the art will recognize that other cutting surface configurations are possible. For example, barb projections, spikes and the like can also provide a cutting surface. Further, perimeter surface 62 can be a single sharp edge extending around rotating disk 52. In another embodiment, instead of rotating disks, cutting tool 46 can be a sheering device, or scissor tool or the like.

Thus it is apparent that there has been described, in accordance with the invention, a method of fabricating a polishing pad having an optical window that fully provides the advantages set forth above. Although the invention has been described and illustrated with reference to specific illustrative embodiments thereof, it is not intended that the invention be limited to those illustrative embodiments. Those skilled in the art will recognize the variations and modifications can be made without departing from the spirit of the invention. For example, although the pad material is illustrated herein as including a polishing layer and a backing layer, additional layers of material are possible, including layers intermediate to the polishing layer and the backing layer. It is therefore intended to include within the invention all such variations and modifications as fall within the scope of the appended claims and equivalents thereof.

What is claimed is:

1. A method of fabricating a polishing pad comprising:

providing a pad material having a polishing layer overlying a substantially optically transparent layer;

cutting away a portion of the polishing layer from the substantially optically transparent layer by positioning the pad material on a cutting surface and cutting the polishing layer with a cutting tool by moving the pad material relative to the cutting tool;

wherein the cutting surface comprises a movable vacuum table, and wherein moving the pad material relative to the cutting tool comprises placing the pad material on the movable vacuum table and laterally moving the vacuum table relative to the cutting tool.

2. A method of fabricating a polishing pad comprising:

placing a pad material on a movable surface, wherein the pad material includes a polishing layer overlying an optically transparent layer;

bringing a cutting tool into contact with the pad material; and cutting away a portion of the polishing layer, wherein the cutting tool includes a rotating disk transversely mounted to a shaft, and moving the surface at a right angle with respect to a major axis of the shaft.

3. The method of claim 2, wherein cutting away the portion of the polishing layer comprises cutting with a rotating disk having a plurality of cutting teeth arranged on a perimeter surface of the disk.

* * * * *